US006097910A

United States Patent [19]

Sasaki et al.

[11] Patent Number: 6,097,910

[45] Date of Patent: Aug. 1, 2000

[54] COMBINED CONSUMABLE MATERIAL SUPPLY CARTRIDGE FOR IMAGE REPRODUCTION DEVICES

[75] Inventors: Kohki Sasaki; Satoru Tomita; Tetsuo Watanabe; Shigeharu Uda, all of Kanagawa, Japan

[73] Assignee: Ricoh Company, Ltd., Japan

[21] Appl. No.: 09/163,662

[22] Filed: Sep. 30, 1998

[30] Foreign Application Priority Data

Sep. 30, 1997 [JP] Japan ..... 9-265805
Mar. 24, 1998 [JP] Japan ..... 10-075452

[51] Int. Cl.[7] ..... G03G 21/18; G03G 15/00; G03G 21/16; G03G 15/08

[52] U.S. Cl. ..... 399/111; 399/114; 399/262

[58] Field of Search ..... 399/107, 110, 399/111, 112, 113, 114, 115, 116, 117, 118, 119, 120, 121, 122, 123, 124, 125, 126, 262, 299, 306–411

[56] References Cited

U.S. PATENT DOCUMENTS

| | | | |
|---|---|---|---|
| 5,172,168 | 12/1992 | Satoh et al. | 355/245 |
| 5,294,960 | 3/1994 | Nomura et al. | 399/113 |
| 5,298,946 | 3/1994 | Haneda et al. | 355/210 |
| 5,615,001 | 3/1997 | Kawashima et al. | 399/226 |
| 5,752,137 | 5/1998 | Haneda | 399/223 |
| 5,787,324 | 7/1998 | Iwasaki | 399/112 |
| 5,799,230 | 8/1998 | Lloyd | 399/107 |

FOREIGN PATENT DOCUMENTS

| | | |
|---|---|---|
| 5-19541 | 1/1993 | Japan . |
| 8-160841 | 6/1996 | Japan . |
| 8-179629 | 7/1996 | Japan . |

*Primary Examiner*—Richard Moses
*Attorney, Agent, or Firm*—Knoble & Yoshiba LLC

[57] ABSTRACT

A supply cartridge contains at least two types of consumable material which are exhausted substantially at the same time over a course of ordinary image reproduction, and the supply cartridge lacks any substantial replacement part so that the supply cartridge replacement wastes no residual life of replacement hardware parts.

29 Claims, 18 Drawing Sheets

FIG. 11

SUPPLY CARTRIDGE COMBINATION TABLE

| CODE | RECORDING MEDIUM | | | IMAGE-CARRYING MEDIUM TYPE | | | IMAGE-RECORDING MEDIUM CAPACITY | |
|---|---|---|---|---|---|---|---|---|
| 8 7 6 5 4 3 2 1 | REGULAR PAPER | HIGH QUALITY PAPER | OHP | A | B | C | 100 | 50 |
| | ○ | | | ○ | | | ○ | |
| | ○ | | | ○ | | | | ○ |
| | | | ○ | | | ○ | ○ | |
| | | | ○ | | | ○ | | ○ |

COMBINED CONSUMABLE MATERIAL SUPPLY CARTRIDGE FOR IMAGE REPRODUCTION DEVICES

FIELD OF THE INVENTION

The current invention is generally related to a supply cartridge for an image reproduction device, and more particularly related to a supply cartridge which contains at least two types of consumable material which are exhausted substantially at the same time over a course of ordinary image reproduction.

BACKGROUND OF THE INVENTION

Image reproduction devices such as a printer, a photocopier and a facsimile machine require constant maintenance. One aspect of the maintenance includes a constant supply of consumable material such as an image-carrying medium and an image-recording medium. For example, over an ordinary course of image reproduction, paper and toner have to be replenished in a photo copier. Another aspect of the maintenance includes replacement of certain parts of the image reproduction device. These certain parts are generally designed to be replaced after a predetermined amount of image reproduction. For example, a photoreceptor is to be replaced in a photocopier after a predetermined amount of copying. In order to facilitate the above described maintenance, certain prior art replacement cartridges included a combination of elements so that the replacement simultaneously replenishes a consumable material and replaces a part.

Under the above described replacement concept, three are at least two groups of replacement cartridges. One group of replacement cartridges is designed for ink jet printers and includes a ink jet head as well as ink supply. In other words, as soon as the ink supply is exhausted, by replacing the cartridge, the ink is replenished and the ink jet head is also replaced. The other group of replacement cartridges is designed for electrophoto-imaging devices and includes a process unit such as a photoreceptor and a developer as well as developer material. Similarly, as soon as the developer is exhausted, the developer is replenished and the process unit is also replaced. For example, the second group of replacement cartridges is disclosed in Japanese Patent Publications Hei 8-160841 and Hei 8-179629 as well as Japanese Patent Hei 5-19541.

The above described prior art replacement cartridges nonetheless usually waste a residual life of the replacement hardware part. This is because the hardware part generally outlasts a supply portion of the replacement cartridge. In other words, a capacity of the supply is limited due to the size of the replacement cartridge, and the supply is exhausted before the replacement hardware needs to be replaced. The overall size of the replacement cartridges is limited especially for a portable or desktop image reproduction devices. To avoid such a wasteful replacement, it is desired that the replacement cartridges for image reproduction devices need to be improved.

SUMMARY OF THE INVENTION

In order to solve the above and other problems, according to a first aspect of the current invention, a supply cartridge for an image reproduction device, includes a first holding unit for holding a first predetermined amount of a first consumable material for the use in reproduction of images; and a second holding unit integrally located near the first holding unit for holding a second predetermined amount of a second consumable material for the use in the reproduction of the images, the first consumable material and the second consumable material being exhausted at a substantially same time over a course of ordinary image reproduction.

According to a second aspect of the current invention, a supply cartridge for an image reproduction device, includes a first holding unit for holding a first predetermined amount of an image-carrying medium; and a second holding unit integral with the first holding unit and sharing a dividing wall between the first holding unit and the second holding unit for holding a second predetermined amount of an image-recording medium, the image-carrying medium and the image-recording medium being exhausted at a substantially same time over a course of ordinary image reproduction.

According to a third aspect of the current invention, an apparatus for reproducing images, includes a disposable supply cartridge having an outer surface for holding a first predetermined amount of image-carrying medium and a second predetermined amount of image-recording medium; an image-reproduction unit located near the disposable supply cartridge unit for reproducing an image using the image-carrying medium on the image-recording medium, wherein the image-carrying medium and the image-recording medium being exhausted at a substantially same time over a course of ordinary image reproduction; and a supply cartridge holding unit located on the outer surface for detachably placing the disposable supply cartridge at a predetermined location with respect to the image-reproduction unit.

According to a fourth aspect of the current invention, a method of supplying consumable material to an image reproduction device, includes: packaging a first predetermined amount of a first consumable material in a disposable cartridge for use in reproduction of images; packaging a second amount of a second consumable material in the disposable cartridge for use in the reproduction of the images, the second amount being corresponding to the first amount so that the first consumable material and the second consumable material are exhausted at a substantially same time over a course of ordinary image reproduction; and detachably placing the disposable cartridge in the reproduction device.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 9 illustrates an optical label and an optical detector while

FIG. 11 is one example for further illustrating an encoding scheme for eight-bit information in an optical label.

DETAILED DESCRIPTION OF THE PREFERRED EMBODIMENT(S)

Figure 1:
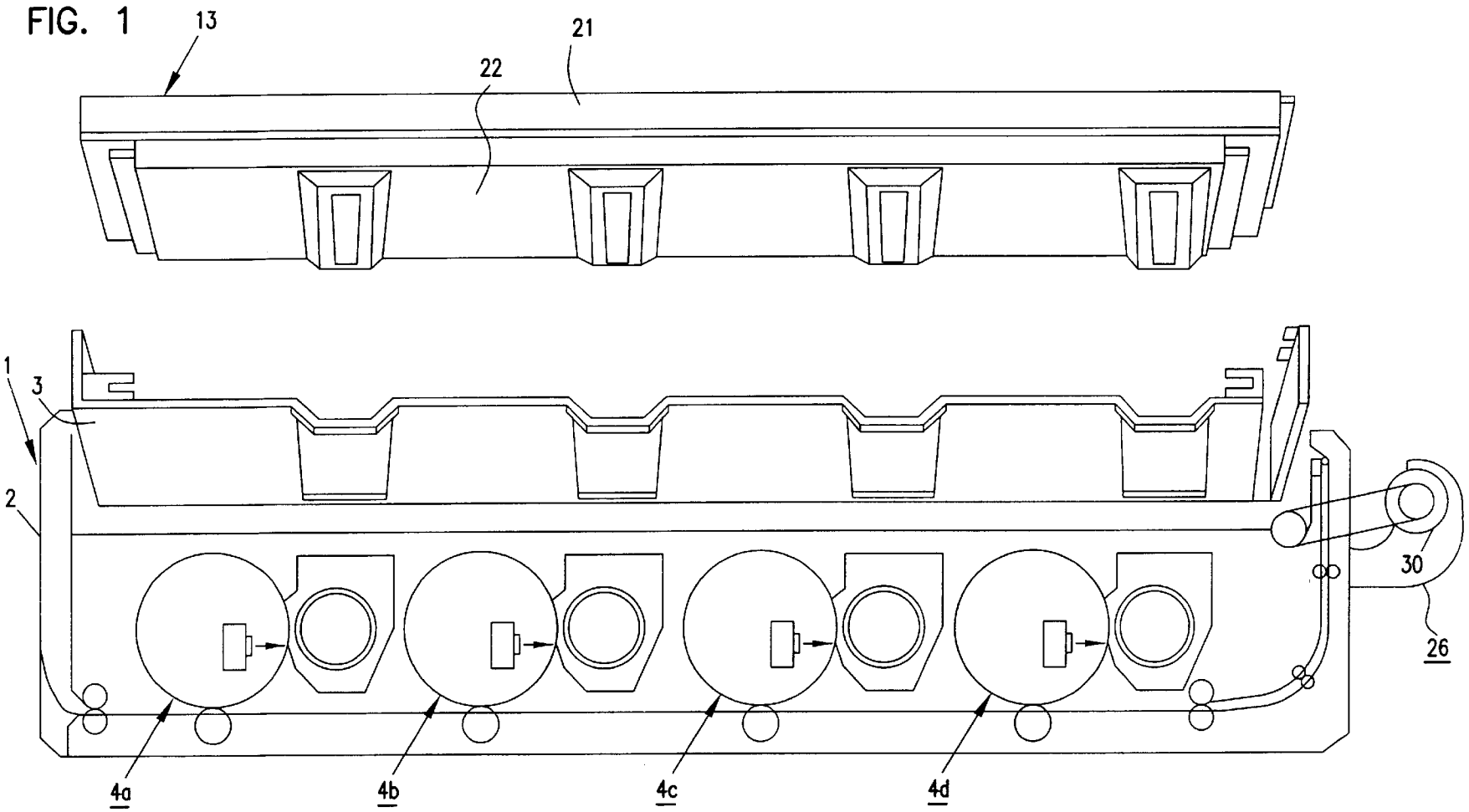
FIG. 1 illustrates one preferred embodiment of the image reproduction system according to the current invention.

Referring now to the drawings, wherein like reference numerals designate corresponding structure throughout the views, and referring in particular to FIG. 1, one preferred embodiment of the image reproduction system according to the current invention is illustrated. In general, the preferred embodiment includes a supply cartridge 13 and an image reproduction device 1. The image reproduction device 1 is illustrated in a cross sectional side view while the supply cartridge 13 and a supply cartridge holder 3 are illustrated in a partial prospective view. The cartridge holder 3 is movably hinged at a far end, and the cartridge holder 3 is at a lifted position. The supply cartridge 13 is illustrated in a detached position. The image reproduction device 1 includes a main body 2 with an open top configuration, and the top portion includes the supply cartridge holder 3 for holding the supply cartridge 13. The image reproduction device 1 also includes four image generation units 4*a*, 4*b*, 4*c* and 4*d* each with substantially identical components each of which generates a portion of an image in a predetermined primary color. The image reproduction device 1 further includes a the recording medium transfer unit 26, and a recording medium transfer roller 30 is pivotally positioned over the supply cartridge 13 when the supply cartridge 13 is placed at a predetermined supply position in the image reproduction device 1.

Figure 2A:
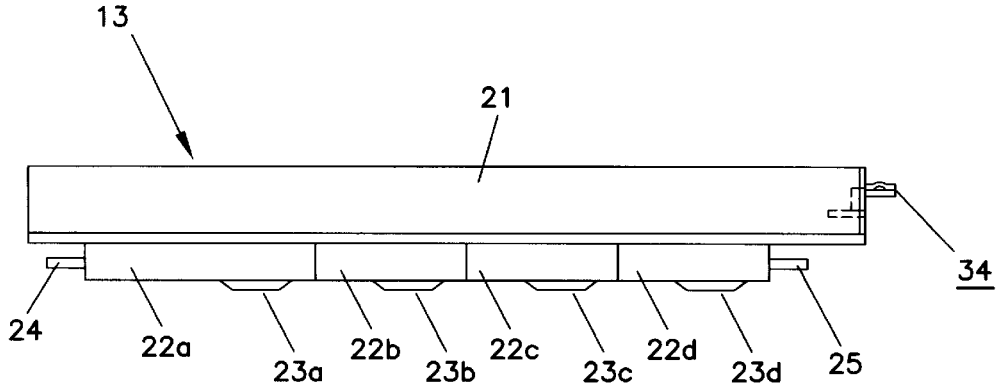
FIGS. 2A, 2B and 2C respectively illustrate a side view, a cross sectional view and a top perspective view of one preferred embodiment of the supply cartridge according to the current invention.
Figure 2B:
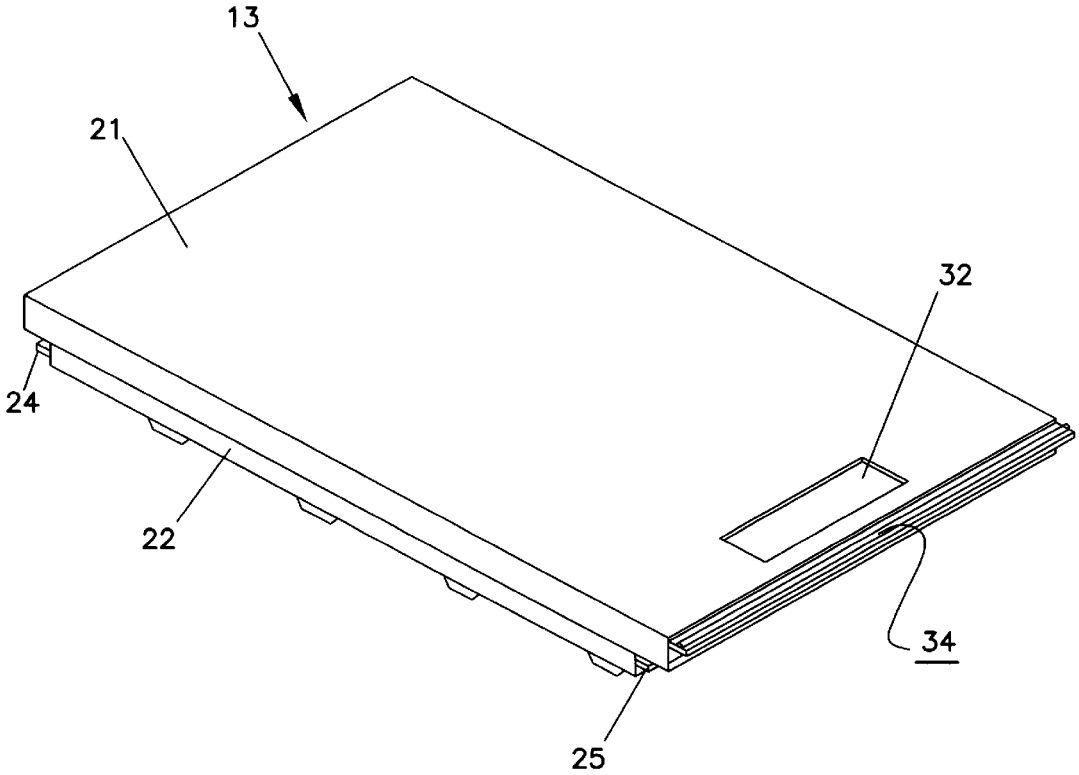
Figure 2C:
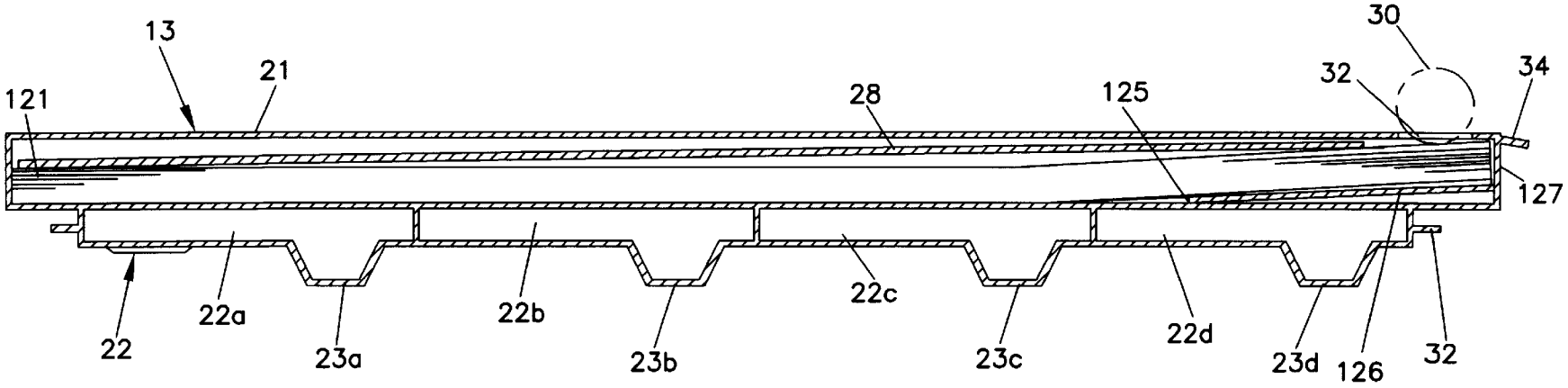

Referring to FIGS. 2A, 2B and 2C, one preferred embodiment of the supply cartridge according to the current invention is respectively illustrated in a side view, a cross sectional view and a top perspective view. The supply cartridge 13 includes a first consumable material holding unit 21 and a second consumable material holding unit 22. According to the current invention, these holding units 21 and 22 each contain a predetermined type of consumable material in a predetermined amount so that these predetermined consumable media are exhausted at substantially the same time over a normal course of image reproduction. In other words, when the supply cartridge 13 is replaced, the holding units 21 and 22 are both substantially empty. For example, the supply cartridge 13 according to the current invention holds an image-recording medium such as paper or transparency in the first consumable material holding unit 21 and an image-carrying medium such as toner or ink in the second consumable material holding unit 22.

Still referring to FIGS. 2A, 2B and 2C, the preferred embodiment of the supply cartridge 13 according to the current invention further includes the following additional components. The first consumable material holding unit 21 also includes an image recording medium releasing outlet or shutter 34 on one end of the supply cartridge. The releasing outlet 34 opens as the supply cartridge 13 is attached to the image reproduction device 1 while the releasing outlet 34 closes as the supply cartridge 13 is detached from the image reproduction device 1. The shutter 34 prevents undesirable moisture and dust from entering into the first consumable material holding unit 21 when the supply cartridge 13 is detached from the image reproduction device 1. The second consumable material holding unit 22 is further divided into compartments 22*a*, 22*b*, 22*c* and 22*d*. For example, these compartments 22*a–d* separately hold cyan toner, magenta toner, yellow toner and black toner. These primary colors of toner are separately released from corresponding toner releasing outlets 23*a*, 23*b*, 23*c* and 23*d*. The supply cartridge 13 further includes a first projection 24 located on a first side and a second projection 25 on a second side. These projections each engage in a predetermined groove upon attaching the supply cartridge in the image reproduction device 1. Lastly, as illustrated in FIG. 2B, a top surface of the supply cartridge 13 has an opening or window 32 for providing access to the recording medium.

FIG. 2C further illustrates in a cross sectional view other features of the preferred embodiment of the supply cartridge according to the current invention. A first consumable material holding unit 21 contains a predetermined number of sheets of image-recording medium 121. One end of the first consumable material holding unit 21 has a shutter 34, and near the shutter 34, a part of the transfer roller 30 is pivotally positioned into the first consumable material holding unit 21 through an opening 32 when the supply cartridge 13 is positioned at a predetermined dispensing position. A base plate 126 in the first consumable material holding unit 21 urges the sheets of the recording medium upwardly toward the transfer roller 30. The base plate 126 further includes a predetermined height of a side wall 127 to vertically stack the recording medium and to allow only one top sheet of the recording medium to slide towards the shutter 34. To cause the upward urge, an urging means 125 such as springs is placed between the base plate and a floor of the first consumable material holding unit 21. Between the top of the recording medium and a ceiling wall of the first consumable material holding unit 21, a top plate is optionally inserted to prevent a bending or a folding line on the image-recording medium.

Still referring to FIG. 2C, the second consumable material holding unit 22 is divided into compartments for separately containing image-carrying material such as toner and ink until the supply cartridge is installed in an image-reproduction device. Although image-carrying material outlets 23*a*, 23*b*, 23*c* and 23*d* are closed and leak-free prior to installment of the supply cartridge 13, upon installment, the outlets 23*a–d* allow the passage of the image-carrying medium.

Figure 3:
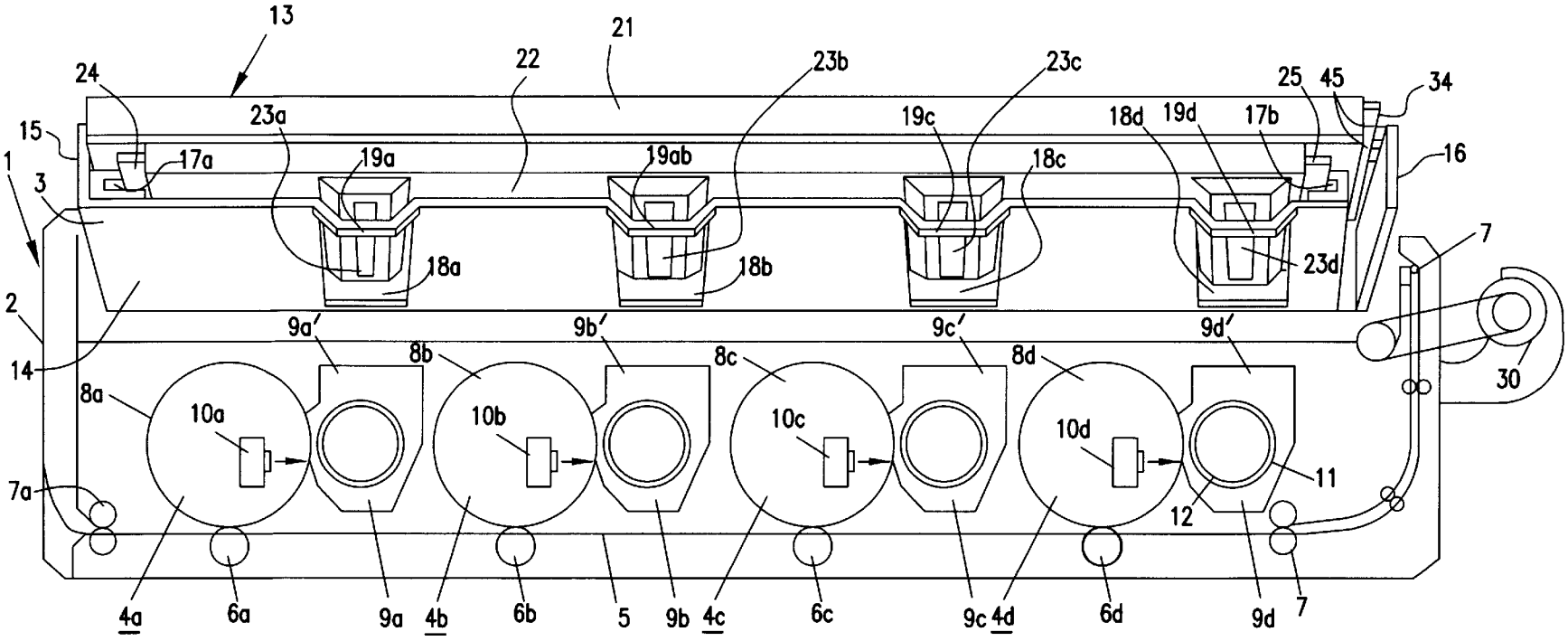
FIG. 3 illustrate one position in installing one preferred embodiment of the supply cartridge for an image reproduction system according to the current invention.

Now referring to FIG. 3, the supply cartridge 13 and the supply cartridge holder 3 are illustrated in a partial perspective view since the cartridge holder 3 is movably hinged at a far end and the cartridge holder 3 is at a lifted position. In contrast, the image reproduction device 1 is illustrated in a cross sectional side view. The supply cartridge 13 is placed almost entirely in the supply cartridge holder 3. The projections 24 and 25 of the supply cartridge are accepted in the corresponding grooves 17*a* and 17*b*, and the supply cartridge 13 is positioned at a predetermined position with respect to the image reproduction device 1. As the supply cartridge 13 is slid along the grooves 17*a* and 17*b*, the toner releasing outlets 23*a*, 23*b*, 23*c* and 23*d* are opened and positioned over the corresponding toner accepting entry portions 9*a*, 9*b*, 9*c* and 9*d*. For example, the toner releasing outlets 23*a*, 23*b*, 23*c* and 23*d* are closed with a plastic film to prevent leakage prior to placing in the image reproduction device 1, and the film is ruptured or removed as the supply cartridge is mounted. At the same time, a shutter opener 45 located on a side wall of the supply cartridge holder 3 causes the image recording medium releasing outlet or shutter 34 to open and holds it at the open position.

Still referring to FIG. 3, the supply cartridge holder 3 further includes a cartridge bottom holding plate 14, a first cartridge side holding plate 15 and a second cartridge side holding plate 16. An inner surface of the first side holding plate 15 inwardly projects a guiding piece which has a groove portion 17*a*. Similarly, near the second side holding plate 16, another groove portion 17*b* is also provided. The bottom holding plate 14 has elongated openings 18*a*, 18*b*, 18*c* and 18*d*, which are respectively located directly above corresponding toner accepting entry portions 9*a*′, 9*b*′, 9*c*′ and 9*d*′ when the supply cartridge holder 3 is placed at a predetermined position at the top of the image reproduction device 1. The elongated openings 18*a*, 18*b*, 18*c* and 18*d* are respectively defined by a front edge portion 19*a*, 19*b*, 19*c* and 19*d* to facilitate the attachment and detachment of the supply cartridge 13.

The image reproduction device 1 has four image generation units 4*a*, 4*b*, 4*c* and 4*d* which each further includes a set of substantially identical components, and these components share common reference numerals with an alphabetical suffix. These image generation units 4*a–d* are horizontally arranged along a paper transfer path 5 in the main body 2. Each of the units 4*a–d* further includes a photoreceptor 8*a* through 8*d*, a transfer roller 6*a* through 6*d* and a developer 9*a* through 9*d* and respectively generates an image in a primary color including cyan, magenta, yellow and black. In general, the photoreceptor 8*a–*8*d* is a cylinder having transparent electrodes and an optically active layer. The developer 9*a–*9*d* includes a magnetic roller 11 and a non-magnetic conductive sleeve 12 around the magnetic roller 11. A LED array light source 6*a–*6*d* exposes the photoreceptor drum surface according to a desired image. The conductive sleeve 12 transfers an image-carrying medium such as toner onto the exposed photoreceptor drum surface 8 in response to a voltage signal.

Still referring to FIG. 3, an image-recording medium is transferred from one end of the paper transfer path 5 or a first set of transfer rollers 7 to the other end of the paper transfer path 5 or a second set of fixation rollers 7*a* via each of the image generation units 4*a–d* via a transfer roller 6*a–d*. As described above, each image generation unit 4*a–d* generates an image in a predetermined primary color by transferring the corresponding image-carrying medium onto an image-recording medium. To start the image-recording medium transfer, a transfer roller 30 is pivotally positioned to contact the image-recording medium and moves the image-recording medium towards the transfer path when the supply cartridge 13 is positioned at a predetermined attached position with respect to the image reproduction device 1.

Figure 4:
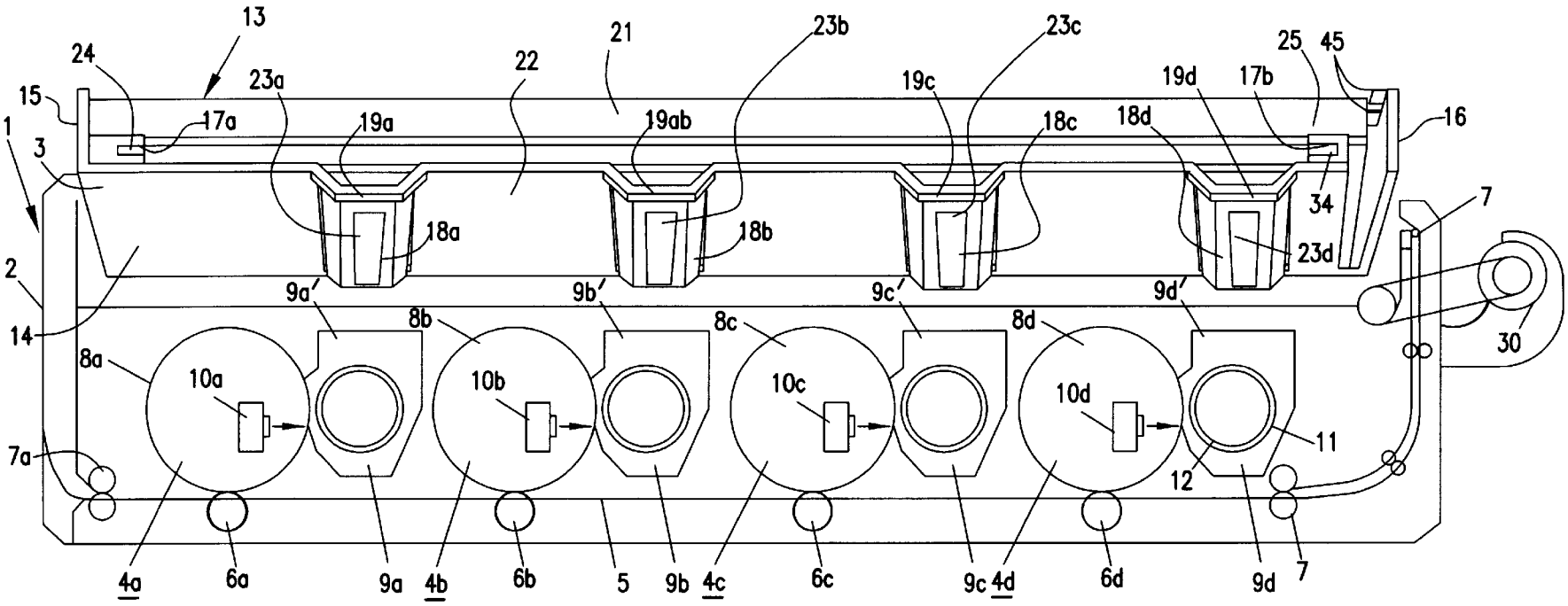
FIG. 4 illustrate a second position in installing one preferred embodiment of the supply cartridge for an image reproduction system according to the current invention.
Figure 5:
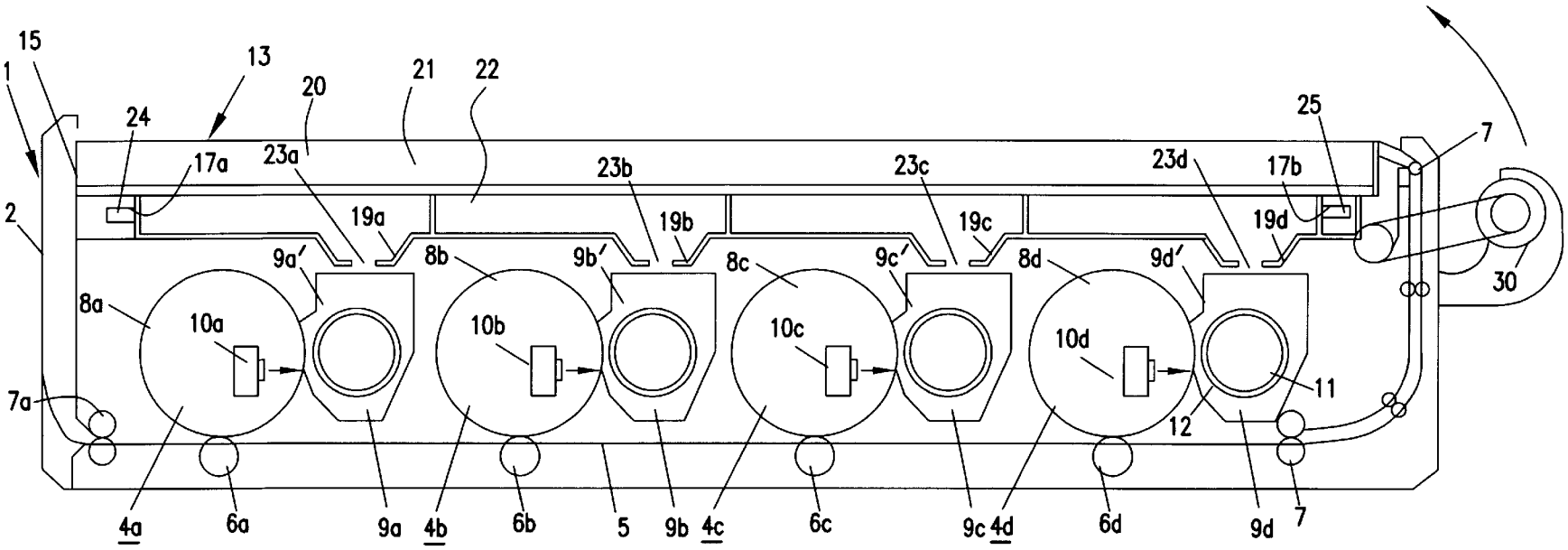
FIG. 5 illustrate an installed position of one preferred embodiment of the supply cartridge for an image reproduction system according to the current invention.

Referring to FIG. 4, the supply cartridge 13 is placed at a predetermined attachment position within the supply cartridge holder 3. Although it is not clear shown, a far or back end of the supply cartridge holder 3 is movably hinged so that a front end is movable. FIG. 5 illustrates that the front end of the supply cartridge holder 3 is lowered, and the supply cartridge 13 is finally placed at a predetermined supply position within the image reproduction device 1. At the predetermined supply position, each of the four toner compartments of the supply cartridge is positioned directly above the corresponding one of the four image generation units 4*a*, 4*b*, 4*c* and 4*d* and provides a predetermined color of toner to the corresponding image generation unit. At the predetermined supply position, a recording medium dispensing opening or shutter 34 located at one end of the image recording medium holding unit 21 is open and adjacently positioned to a image-recording medium transfer path defined by opposing pairs of transfer rollers 7.

Still referring to FIG. 5, the image reproduction device 1 further includes a recording medium transfer unit 26 for transferring a sheet of recording medium from the supply cartridge 13 to the predetermined transfer path defined by a pair of transfer rollers 7. At the predetermined dispensing or supply position, the recording medium transfer unit 26 is pivotally moved as shown by a counter clockwise arrow so that a recording medium transfer roller 30 is positioned over the supply cartridge 13. The transfer roller 30 is driven by a motor driven roller 27 via a belt 28.

Figure 6A:
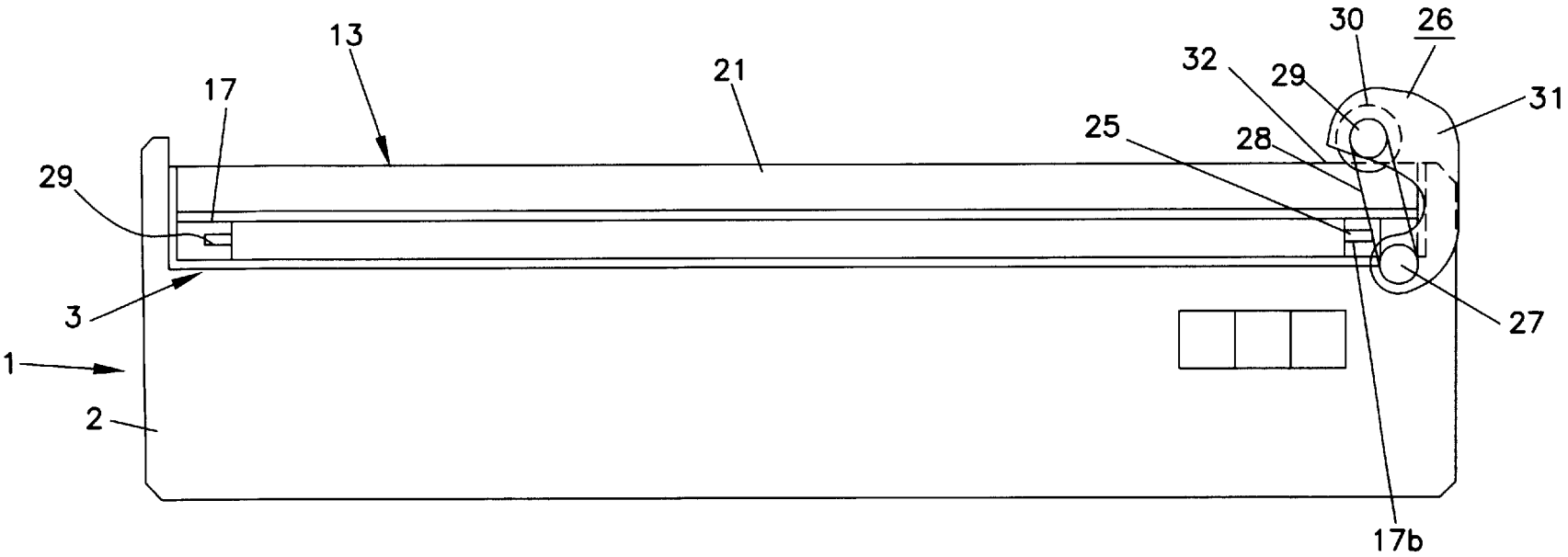
FIGS. 6A and 6B respectively illustrate a side view and a top perspective view of one preferred embodiment of the supply cartridge at a predetermined dispensing position in an image reproduction device.
Figure 6B:
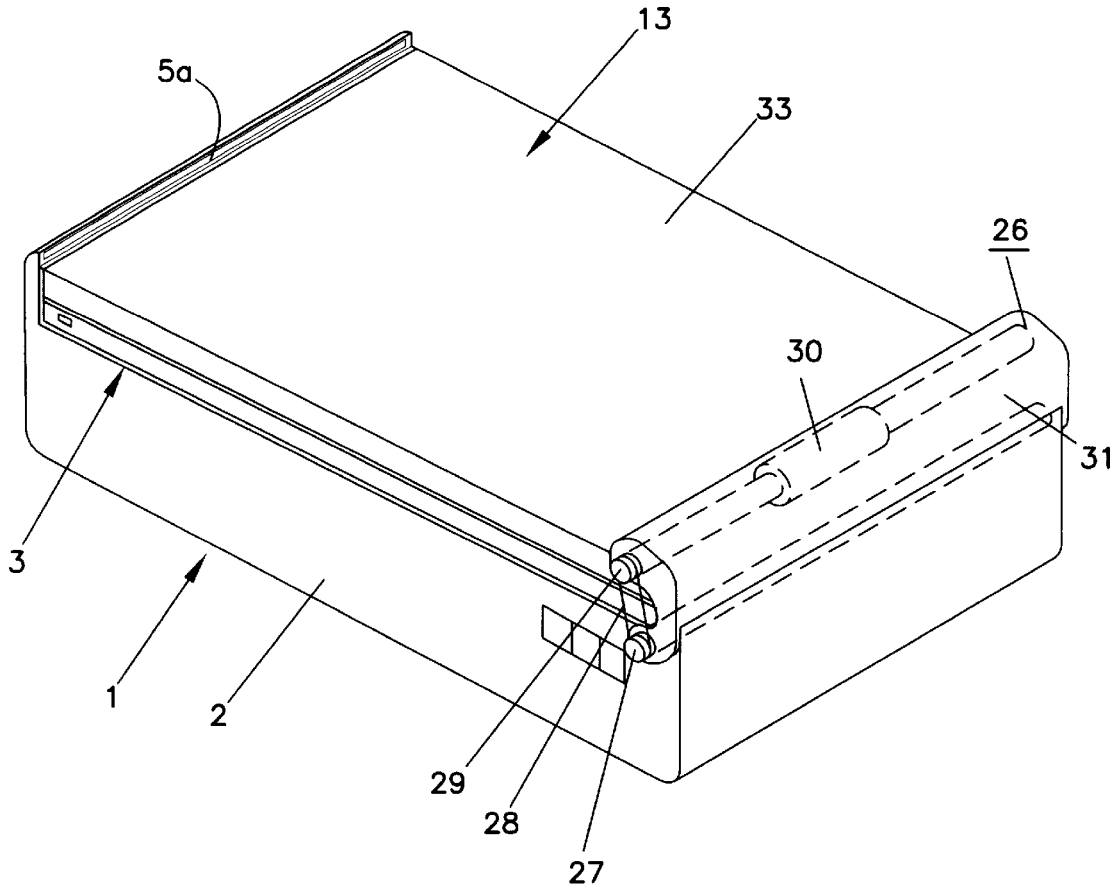

Now referring to FIGS. 6A and 6B, a side view and a top perspective view illustrate that the supply cartridge 13 is positioned at a predetermined dispensing position in an image reproduction device 1. A part of a transfer roller 30 of the recording medium transfer unit 26 is now pivotally positioned in an access window 32 and contacts the recording medium in a first consumable material holding unit 21. The transfer roller 30 has a larger diameter and a higher friction surface than those of a rod 29 on which the transfer roller sits. The driving roller 27 drives the transfer roller 30 via a belt 28 and the rod 29 to rotate in a counter clockwise direction, and the transfer roller 30 contacts with one sheet of the recording medium at a time so as to remove it from the image recording medium holding unit 21 into the transfer path. A top surface 33 of the supply cartridge 13 is used as an output collection tray by outputting the recording medium from an output outlet 5*a*. In another preferred embodiment of the recording medium transfer unit 26, the housing 31 and or the roller 30 function to hold the supply cartridge 13 at the predetermined dispensing position.

Figure 7A:
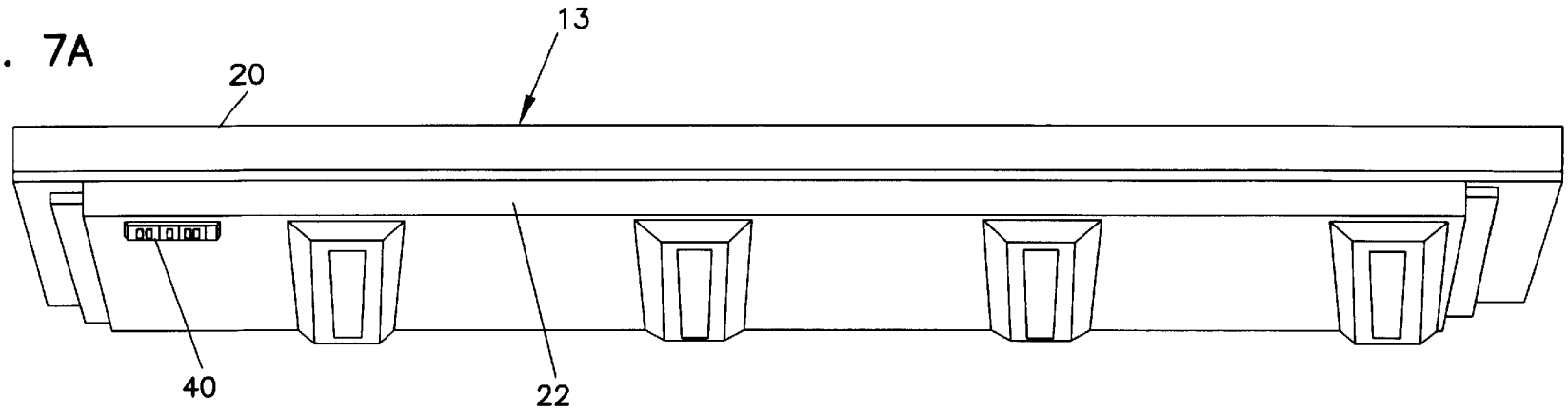
FIG. 7A illustrates another preferred embodiment of the supply cartridge with a content indicator according to the current invention.
Figure 7B:
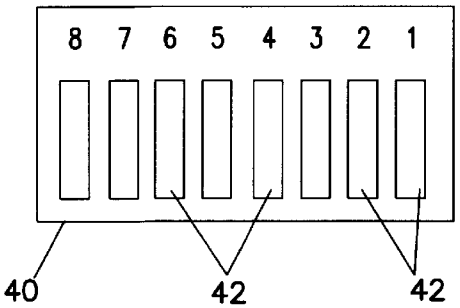
FIG. 7B is a close up view of one example of the content indicator according to the current invention.

Now referring to FIG. 7A, another preferred embodiment of the supply cartridge according to the current invention includes a first consumable material holding unit 21, a second consumable material holding unit 22 and a content indicator 40. In general, the indicator 40 is placed on an outer surface of the supply cartridge 13 and contains information such as a type and an amount of the first as well as second consumable material. One example of the indicator 40 is an optical label and placed on a bottom outer surface of the supply cartridge 13 as shown in FIG. 7B and contains eight strips 42 of the optically detectable surfaces. Each of these optical surfaces 42 can be coded by making it either reflective or non-reflective. The eight strips thus encode eight bits of information.

Figure 8A:
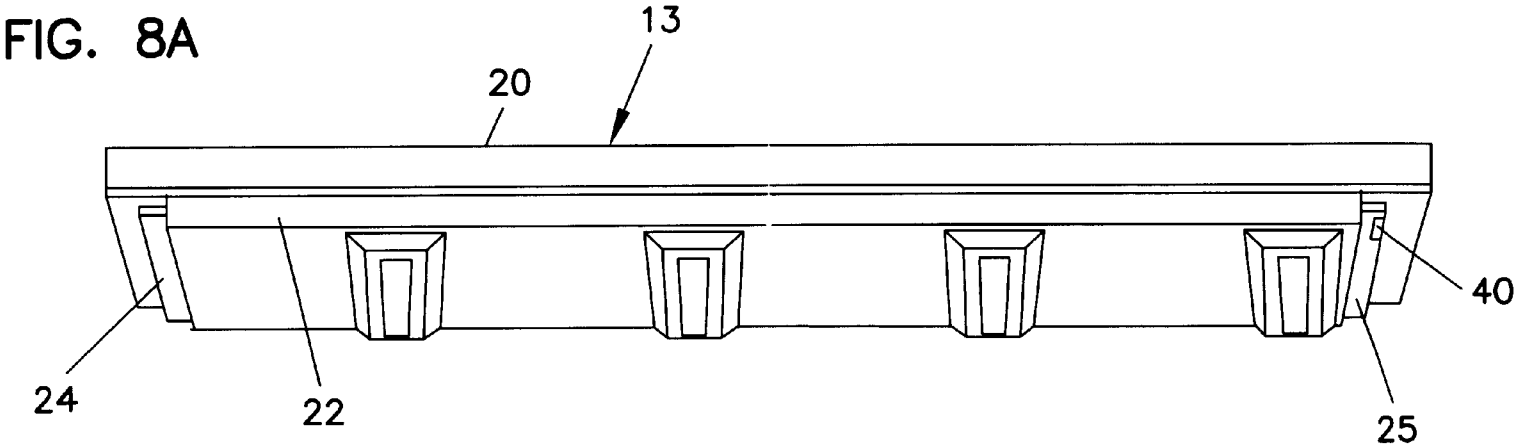
FIGS. 8A and 8B respectively illustrate a perspective view and a close up view of an alternative embodiment of the supply cartridge with a content indicator according to the current invention.
Figure 8B:
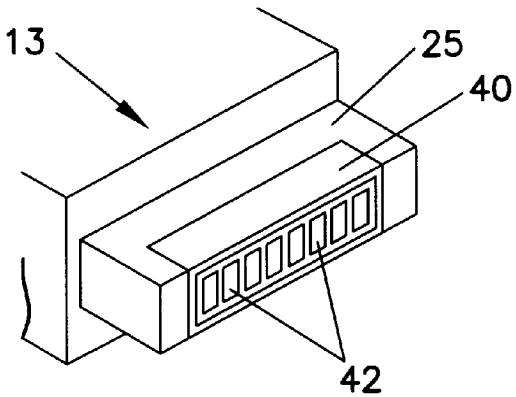

FIGS. 8A and 8B illustrate another example of the indicator 40 location. The indicator is located on an outer surface of a projection 25 of the supply cartridge. FIG. 8B further illustrate that the content indicator 40 is placed on a vertical side surface of the projection 25, and the information is read from the same surface of the indicator 40.

Figure 9:
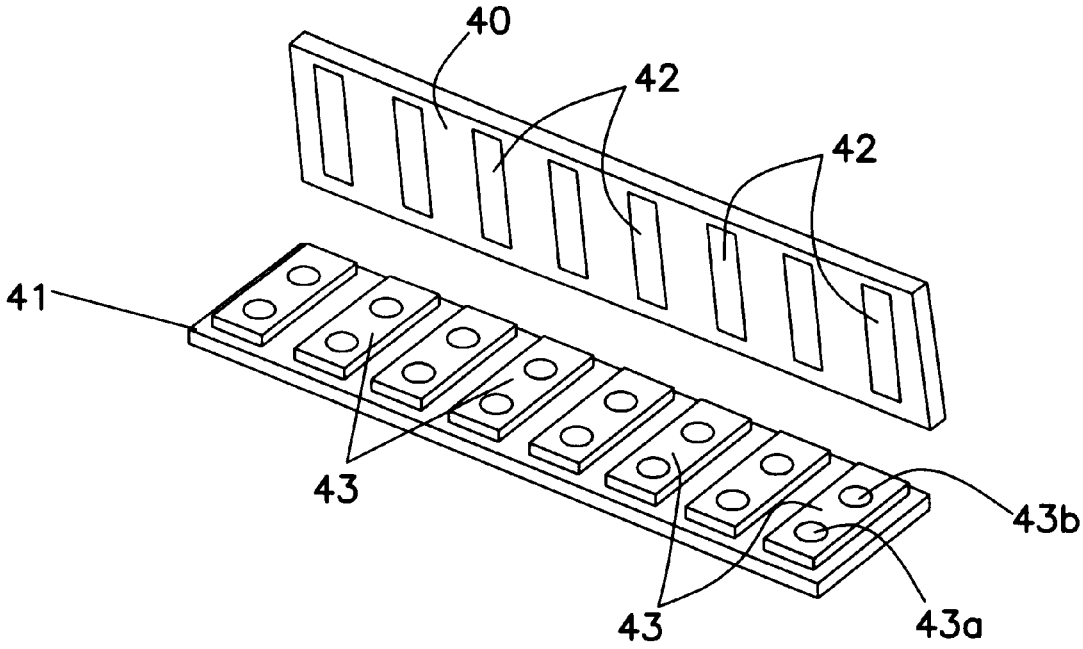
Figure 10:
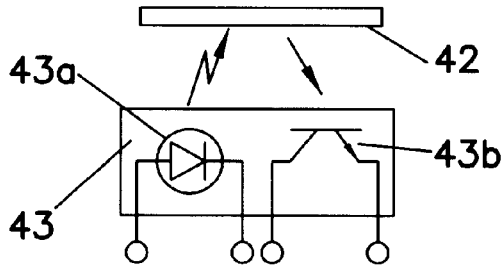
FIG. 10 is an equivalent circuit diagram.

To implement the above described optical labeling system, FIG. 9A illustrates an optical indicator 40 and an optical detector 41. In general, the optical detector is located in an image reproduction device and is adjacent to the optical indicator 40 when the supply cartridge is placed at a dispensing position in the image reproduction device. For this exemplary optical detection unit 41, for each optical strip 42, there is an independent pair of a light source 43*a* and a light detection element 43*b*. The light source 43*a* emits a predetermined amount of light towards a corresponding optical strip 42, and the corresponding optical detection element 43*b* detects whether or not light is reflected by the optical strip 42. The optical detection element in turn generates a signal indicative of the detection result. The generated signal is used to adjust certain parameters or conditions of a predetermined set of components in an image reproduction device. FIG. 9B is a circuit diagram of one pair of the optical strip 42 and the optical detection element 43. As described above, the optical detection element 43 includes the emitter 43*a* and the optical detector 43*b*.

Now referring to FIG. 11, one example further illustrates an encoding scheme for eight-bit information. Among the eight code strips, a dark strip indicates a non-reflective surface while a light strip indicates a reflective surface. According to this example, the first and second strips code a type of a recording medium. That is, if the first strip is non-reflective, regular paper is contained in the first consumable material holding unit. The first and second strips also encode to high-quality paper as well as transparency for an overhead projector (OHP). Still using the same example, the third and fourth strips encode an image-carrying medium type while the fifth and sixth strips encode an image-recording capacity. The image-carrying medium type specifies a particular kind of an image-carrying medium depending upon an image-recording medium type. The recording medium capacity is generally a maximal number of sheets of the image-recording medium.

Figure 12A:
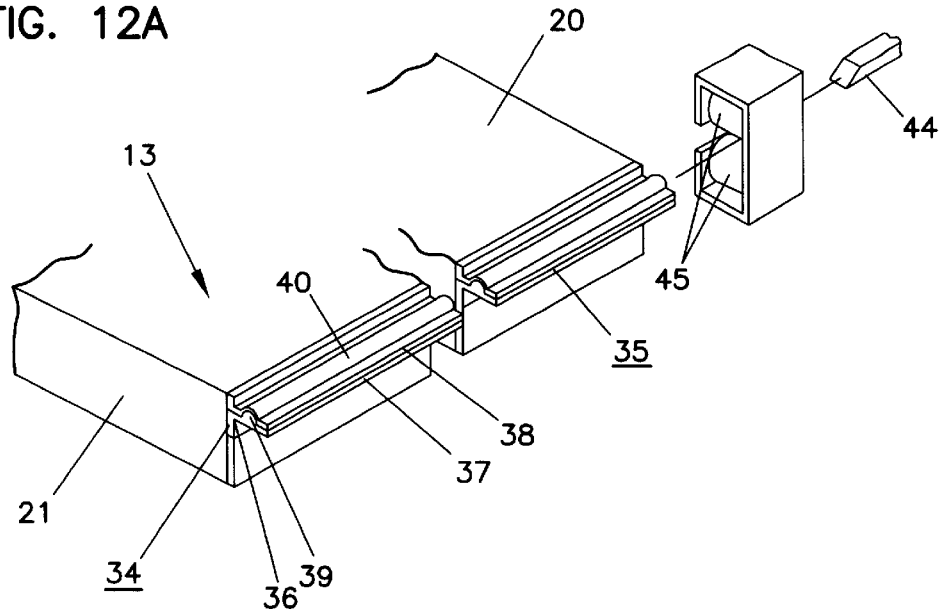
FIGS. 12A, 12B and 12C illustrate one preferred embodiment of the supply cartridge with a movable shutter according to the current invention.
Figure 12B:
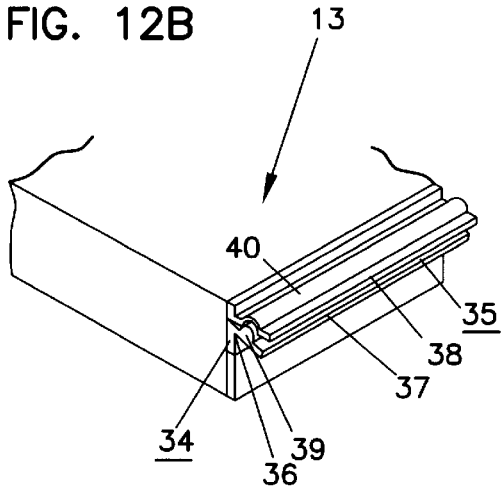
Figure 12C:
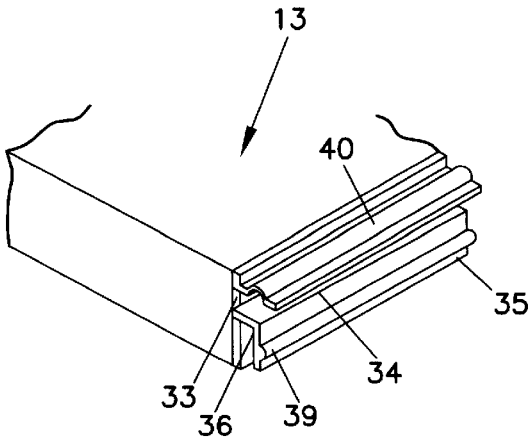

Referring to FIG. 12A, one preferred embodiment of the supply cartridge according to the current invention has a movable shutter or image recording dispensing outlet 34 which is located one side wall. The shutter 34 further includes a movable portion 37 and a fixed portion 38. The movable portion 37 of the shutter 34 further includes a protrusion part 39 while the fixed portion 38 further includes a corresponding indentation part 40. The protrusion part 39 engages the indentation part 40 to maintain a closure along a front end section 35 between the movable portion 37 and the fixed portion 38. Now referring to FIG. 12B, the protrusion part 39 of the movable portion 37 is disengaged from the indentation part 40 of the fixed portion 38. The movable portion 37 is now folded along a thin comer section 36. Finally, referring to FIG. 12C, after the movable portion 37 is completely disengaged from the fixed portion 37, the movable portion 37 rotates in a clock wise direction to provide an opening 33 for outputting an image recording medium.

Referring back to FIG. 12A, to engage the movable portions 37 with the fixed portion 38, the above portions 37 and 38 are rolled through a pair of opposing rollers 45 so that the protrusion part 39 and the indentation part 40 are forced together while the supply cartridge 13 is removed and pulled in a predetermined direction. To disengage the above portions 37 and 38, a plower 44 is placed in a predetermined position so that a wedge-shaped tip of the plower 44 forcefully disengages the protrusion part 39 from the indentation part 40 while the supply cartridge 13 is installed and inserted in a predetermined direction towards the plower 44.

Figure 13:
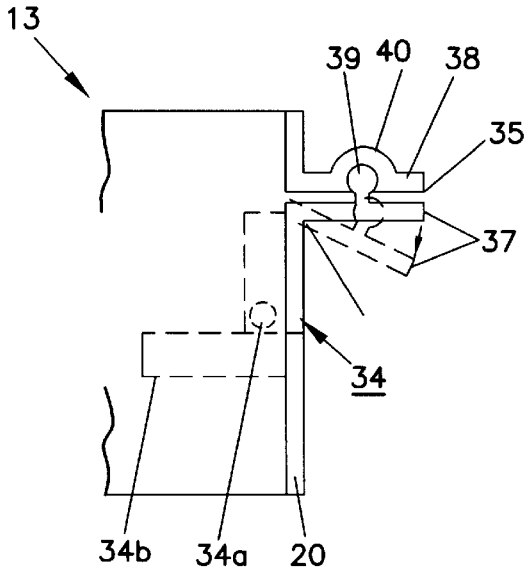
FIG. 13 is a cross sectional view of one preferred embodiment of the supply cartridge with an interlocking shutter according to the current invention.

FIG. 13 is a cross sectional view of one preferred embodiment of the supply cartridge 13 according to the current invention. As described above with reference to FIGS. 12A, 12B and 12C, a shutter 34 includes a fixed portion 38 and a movable portion 37. The protrusion part 39 is shown to disengage from the indentation part 40 as the movable part is rotated in a counter clock direction along the thin comer section 36. The movable portion 34 also rotates around a pivotal point 34*a*. An inner portion 34*b* has a L shape when the movable portion 34 is at the closed position. As the movable portion 34 opens, the inner portion flattens to provide a flat connecting surface near the opening.

Figure 14A:
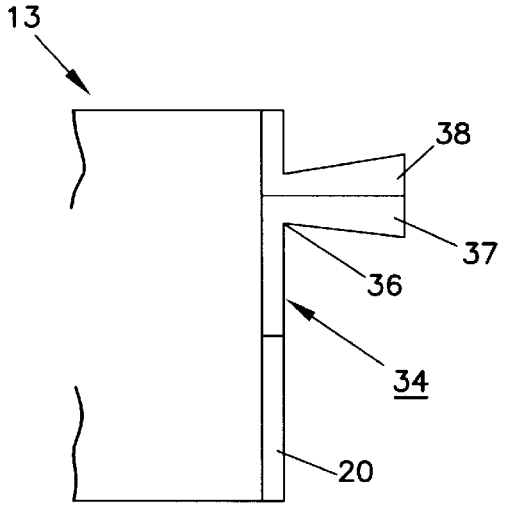
FIGS. 14A and 14B are two side views of an alternative embodiment of the supply cartridge with an interlocking shutter according to the current invention.
Figure 14B:
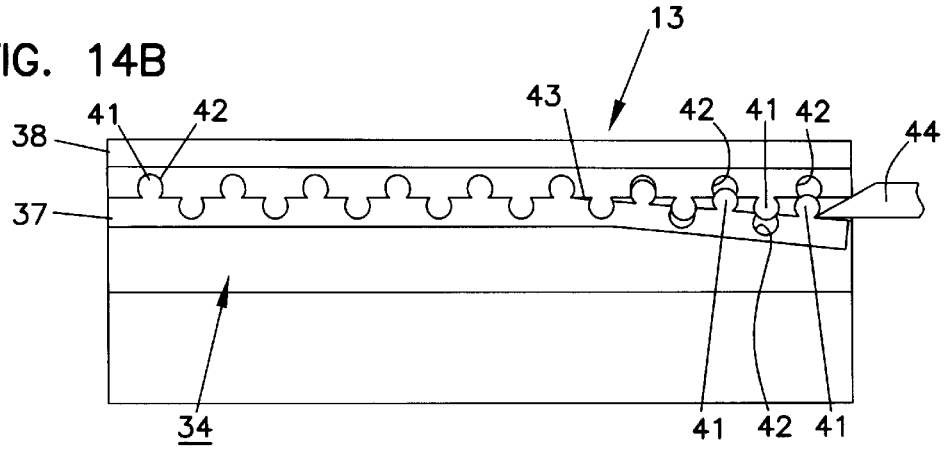

Now referring to FIGS. 14A and 14B, an alternative embodiment of the supply cartridge according to the current invention is illustrated. FIG. 14A is a side view of a shutter 34 illustrating that a movable portion 37 and a fixed portion 38 are closed. FIG. 14B is another side view of the shutter 34 illustrating that protrusion parts 41 and indentation parts 42 remain closed in one part of the supply cartridge 13 while these parts 41 and 42 are being separated by a plower 44. In this alternative embodiment, the protrusion parts 41 are located both on the movable portion 37 as well as the fixed portion 38. Similarly, the indentation parts 42 are also located on both portions 37 and 38. These parts 37 and 38 are interlocking with each other, and a plower 44 disengages the above interlocked parts.

Figure 15A:
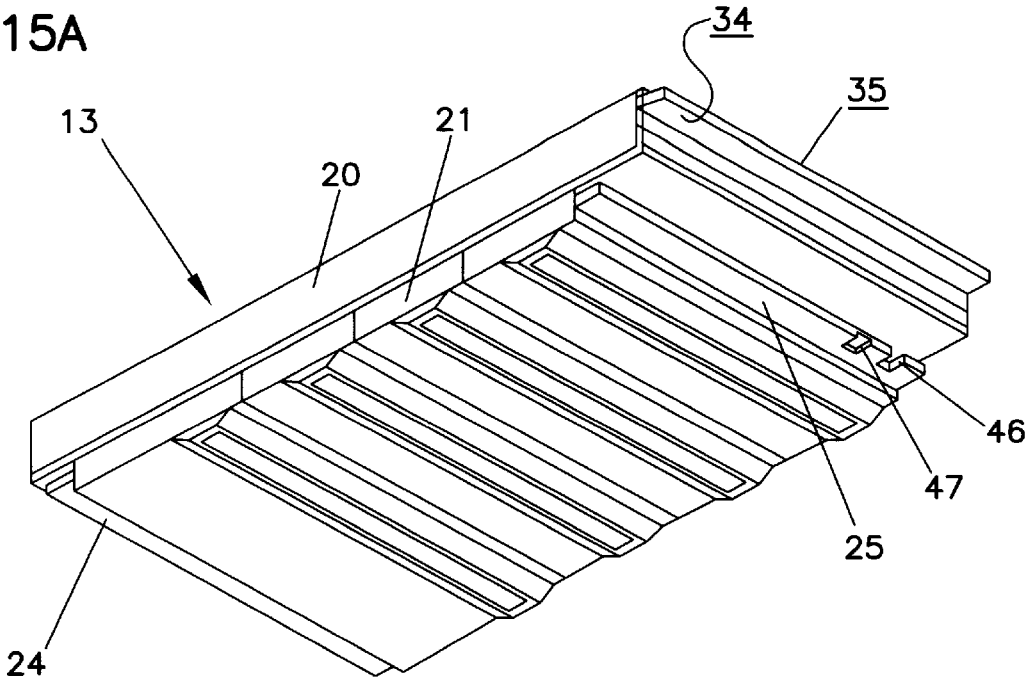
FIGS. 15A and 15B respectively illustrate a perspective view and a close up view of a preferred embodiment of the supply cartridge with position locking portions according to the current invention.
Figure 15B:
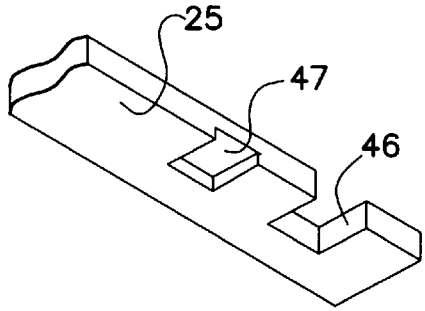

FIGS. 15A and 15B illustrate one preferred embodiment of the supply cartridge according to the current invention. A supply cartridge 13 has projection portions 24 and 25 on each side wall of a second consumable material holding unit 21. The projection 25 further includes a through hole 46 and an indentation portion 47 along its edge. FIG. 15B shows a relevant portion of the projection 25 with more detail. The hole 46 and the indentation 47 are used to position and lock the supply cartridge at a predetermined installment position.

Figure 16A:
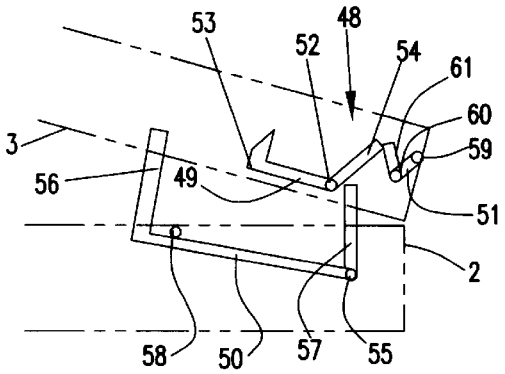
FIGS. 16A through 16E illustrate a sequence of cross sectional views of one preferred embodiment including a supply cartridge holder and a supply cartridge locking unit according to the current invention.

FIGS. 16A through E each illustrate a cross sectional view of a supply cartridge holder 3 and a supply cartridge locking unit 48. Referring to FIG. 16A, over a top portion 2 of an image reproduction device, the supply cartridge holder 3 is located, and one end of the supply cartridge holder 3 is pivotally connected. The supply cartridge locking unit 48 generally includes three sets of levers. A first set is located in the supply cartridge holder 3 and includes a first lever portion A 49 with a first stopper 53 on one end, and the other end is pivotally connected at an axis 52 to a first lever portion B 54. A first lever portion A 49 is urged in a clockwise direction. A second set is located in the top portion 2 and includes a second lever A 50 whose one end is pivotally connected at a point 55 and has an extender 57 and the other end includes a second stopper 56. The extender 57 abuts the first lever portion B 54. The second lever A 50 is urged in a clockwise direction but is limited its movement by a pin 58. A third set is also located in the supply cartridge holder 3 and includes a third lever portion A 51 which is pivotally connected to an axis 59 and a third lever portion B 61 whose one end is joined at a joint 60 and the other end abuts the first lever portion B 54. The third lever set forms a letter V, and the third lever portion A 51 is urged in a clockwise direction.

Figure 16B:
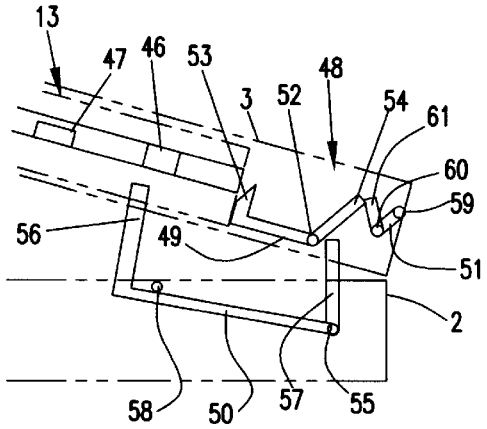

Now referring to the rest of FIGS. 16B through E, the supply cartridge insertion is illustrated. Referring to FIG. 16B, the supply cartridge 13 is inserted into the supply cartridge holder 3 and the stopper 53 is pushed back by a far end of the supply cartridge 13. As a result, the stopper 53 is initially rotated in a counter clockwise direction.

Figure 16C:
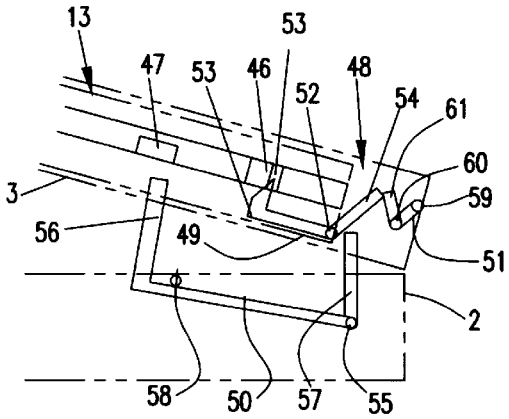
Figure 16D:
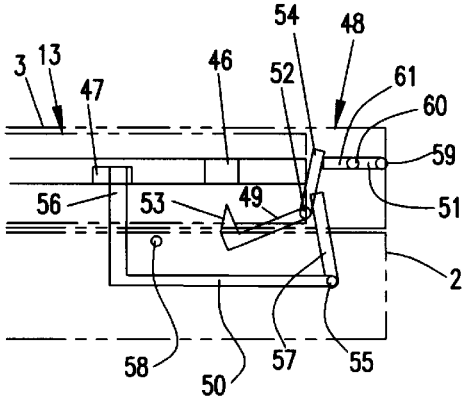
Figure 16E:
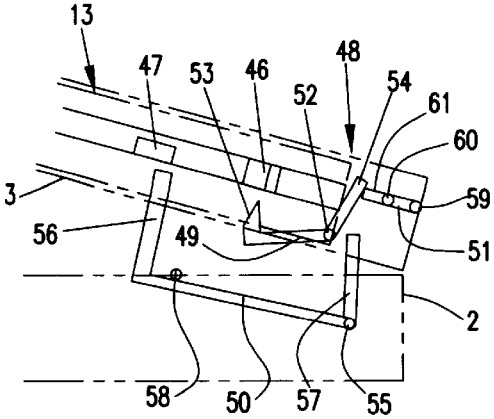

Referring to FIG. 16C, after further insertion of the supply cartridge 13, the stopper 53 engages a through hole 46 on the projection to lock the supply cartridge 13 at a predetermined position within the supply cartridge holder 3. Referring to FIG. 16D, the supply cartridge holder 3 has now been rotated downwardly towards the top portion of the image reproduction device. As a result of the rotation, the first stopper 53 is now disengaged from the hole 46 as the extender 57 pushes the first lever portion B 54 and in turn the first lever portion A 49 in a counterclockwise direction. Also as the result of the rotation, the second stopper 56 is now engagement with the indentation 47. The supply cartridge 13 is now at a predetermined dispensing position. Lastly, referring to FIG. 16E, to remove the supply cartridge 13 from the supply cartridge holder 3, a movable end of the supply cartridge holder 3 is lifted upwardly. The second lever A 50 returns to the original urged position and both first and second stoppers 53 and 56 remain disengaged with the supply cartridge 13. The supply cartridge 13 is thus removed from the supply cartridge holder 3 for replacement.

Figure 17:
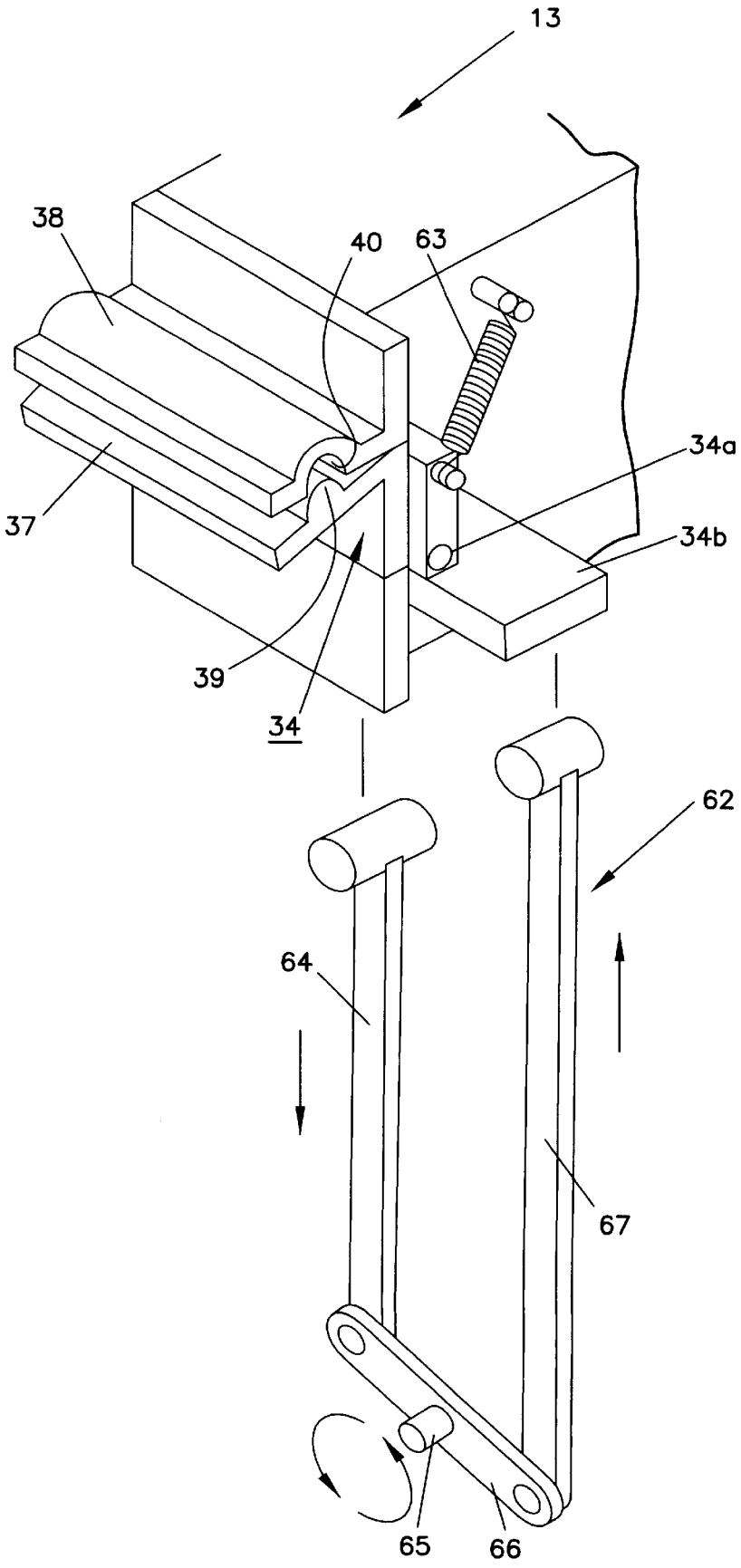
FIG. 17 is a perspective view of one preferred embodiment of the shutter control device and a relevant portion of the supply cartridge according to the current invention.

In relation to the above described installment and removal of the supply cartridge 13, referring to FIG. 17, a shutter control device 62 and a relevant portion of the supply cartridge 13 illustrated in a perspective view. The supply cartridge 13 includes a movable portion 37 which is urged by a spring 63 to a closed position as shown. The movable portion 37 has a first inner plate 34*a* which is attached to the movable portion 37 and is connected to one end of the spring 63. The movable portion 34 also includes a second inner plate 34*b* which is not attached to the movable portion 37 but abuts a bottom portion of the first inner plate 34*a*. The shutter control device 62 includes a pair of first movable arm 67 and a second movable arm 64 which are connected by a rotatable arm 66. As the rotable arm rotates around a pin 65 in a counterclockwise direction, the first arm 67 pushes the second inner plate 34*b* in a upward direction and the second inner plate 34*b* in turn causes the movable portion 37 to open.

Figure 18A:
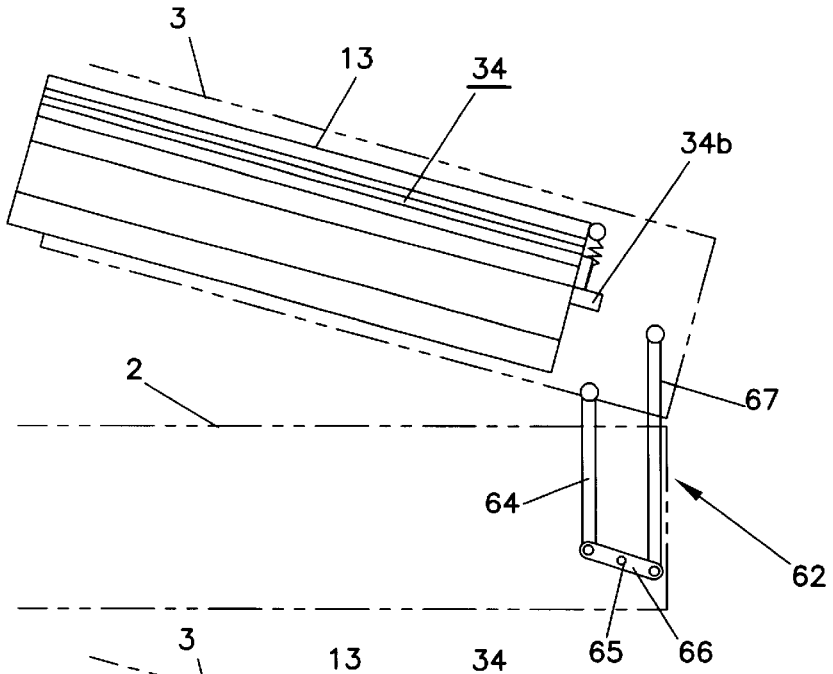
FIGS. 18A through C further illustrate how a shutter control device controls a shutter as a supply cartridge is installed in a supply cartridge holder.
Figure 18B:
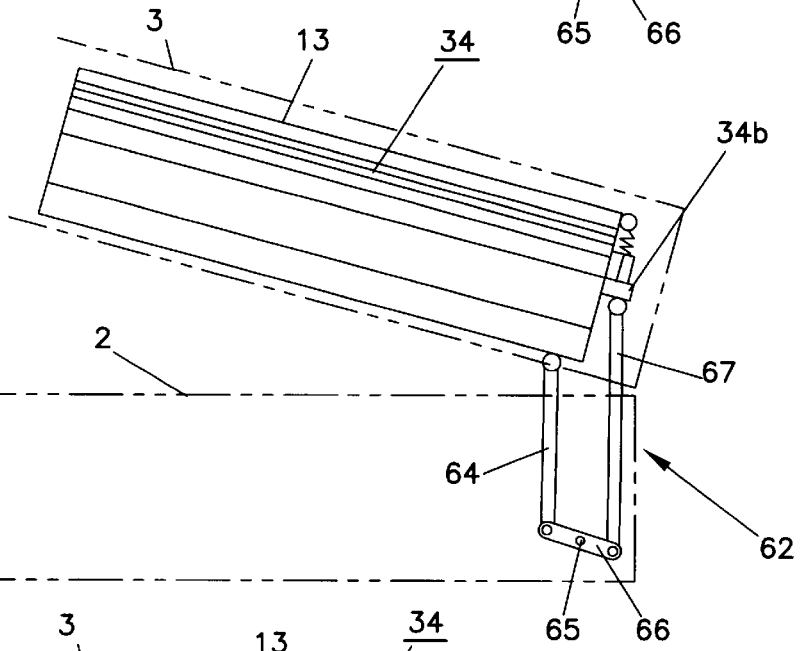
Figure 18C:
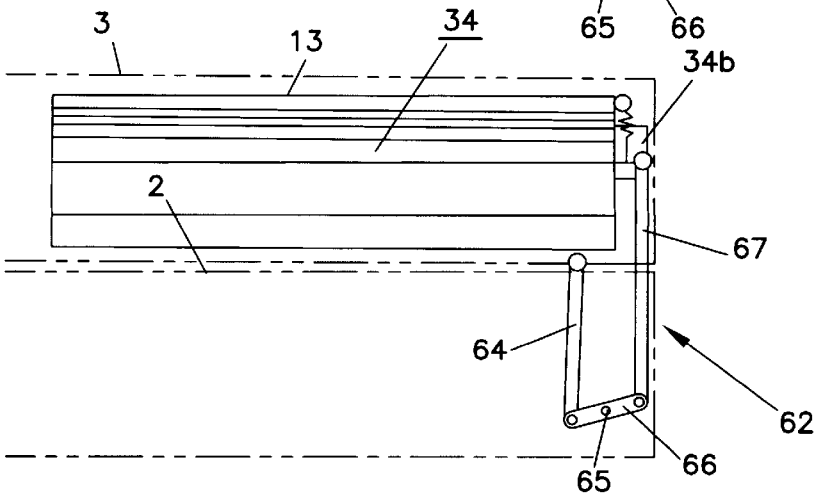

FIGS. 18A through C further illustrate how a shutter control device 62 controls a shutter 34 as a supply cartridge 13 is installed in a supply cartridge holder 3. Referring to FIG. 18A, the supply cartridge 13 inserted into a the supply cartridge holder 3 which is at a cartridge replacement position. The shutter 34 is closed. Referring to FIG. 18B, the supply cartridge is further inserted into the supply cartridge holder 3, and a far end of the supply cartridge 13 reaches the shutter controller 62. A bottom wall of the supply cartridge 13 contacts a second movable arm 64 while a second inner plate 34 abuts a first movable arm 67. Now referring to FIG. 18C, a movable end of the supply cartridge holder 3 is lowered to a predetermined dispensing position to complete the cartridge installment. As a result of the downward movement, the second movable arm 64 is placed downwardly and causes the rotatable arm 66 to rotate in a counterclockwise direction around a pin 65. The rotational movement in turn causes the first movable arm 67 to move upwardly to press the second inner plate 34*b* in the same direction. This upward movement to the second inner plate 34*b* opens the movable portion 37 of the shutter 34 to provide an opening 33. Contrarily, when the supply cartridge holder 3 is lifted to a replacement position, the first movable arm 67 no longer presses the second inner plate 34*b* and the shutter is closed due to the bias. In other embodiments of the supply cartridge according to the current invention, the above described shutter control features and interlocking features are combined.

It is to be understood, however, that even though numerous characteristics and advantages of the present invention have been set forth in the foregoing description, together with details of the structure and function of the invention, the disclosure is illustrative only, and that although changes may be made in detail, especially in matters of shape, size and arrangement of parts, as well as implementation in software, hardware, or a combination of both, the changes are within the principles of the invention to the fill extent indicated by the broad general meaning of the terms in which the appended claims are expressed.

What is claimed is:

1. A supply cartridge for an image reproduction device, comprising:

a first holding unit for holding a first predetermined amount of a first consumable material for the use in reproduction of images; and a second holding unit integrally located over and substantially overlapping said first holding unit for holding a second predetermined amount of a second consumable material for the use in the reproduction of the images, said first consumable material and said second consumable material being exhausted at a substantially same time over a course of ordinary image reproduction.

2. The supply cartridge for an image reproduction device according to claim 1 wherein said first holding unit further comprises a predetermined number of compartments for holding an image-carrying medium.

3. The supply cartridge for an image reproduction device according to claim 2 wherein said image-carrying medium includes cyan toner, magenta toner, yellow toner and black toner.

4. The supply cartridge for an image reproduction device according to claim 1 wherein said second consumable material is image-recording medium.

5. The supply cartridge for an image reproduction device according to claim 4 wherein said image-recording medium includes sheets of paper and transparency.

6. The supply cartridge for an image reproduction device according to claim 1 further comprising an attachment unit located on an outer surface of the supply cartridge for detachably attaching the supply cartridge to the reproduction device.

7. The supply cartridge for an image reproduction device according to claim 6 wherein said attachment unit causes an opening for said second consumable material to travel from the supply cartridge into the reproduction device.

8. The supply cartridge for an image reproduction device according to claim 6 wherein said attachment unit ascertains that said first holding unit is positioned at a predetermined location with respect to the reproduction device.

9. The supply cartridge for an image reproduction device according to claim 8 wherein said attachment unit causes said first holding unit to release said first consumable material to the reproduction device.

10. The supply cartridge for an image reproduction device according to claim 1 further comprises a content indicator located on an outer surface of the supply cartridge for indicating information at least on a specific combination of said first consumable material and said second consumable material.

11. The supply cartridge for an image reproduction device according to claim 10 wherein said content indicator is an optical label.

12. The supply cartridge for an image reproduction device according to claim 1 wherein said first holding unit and said second holding unit share a common dividing wall.

13. A supply cartridge for an image reproduction device, comprising:

a first holding unit for holding a first predetermined amount of an image-carrying medium; and a second holding unit integral with said first holding unit and sharing a dividing wall between said first holding unit and said second holding unit for holding a second predetermined amount of an image-recording medium, said image-carrying medium and said image-recording medium being exhausted at a substantially same time over a course of ordinary image reproduction.

14. The supply cartridge for an image reproduction device according to claim 13 wherein said first holding unit further comprises a predetermined number of compartments for holding said image-carrying medium.

15. The supply cartridge for an image reproduction device according to claim 13 wherein said second holding unit further comprises a tray for holding said image-recording medium.

16. The supply cartridge for an image reproduction device according to claim 15 wherein said tray is urged in a predetermined direction.

17. The supply cartridge for an image reproduction device according to claim 13 further comprises a content indicator located on an outer surface of the supply cartridge for indicating information at least on a specific combination of said image-carrying medium and said image-recording medium.

18. An apparatus for reproducing images, comprising:

a disposable supply cartridge having an outer surface for holding a first predetermined amount of image-carrying medium and a second predetermined amount of image-recording medium;

an image-reproduction unit located near said disposable supply cartridge unit for reproducing an image using the image-carrying medium on the image-recording medium, wherein the image-carrying medium and the image-recording medium being exhausted at a substantially same time over a course of ordinary image reproduction; and a supply cartridge holding unit located on the outer surface for detachably placing said disposable supply cartridge at a predetermined location with respect to said image-reproduction unit.

19. The apparatus for reproducing images according to claim 18 wherein said disposable supply cartridge further comprises an image-recording medium compartment for holding the image-recording medium and an image-carrying medium compartment adjacent to said image-recording medium compartment for holding the image-carrying medium.

20. The apparatus for reproducing images according to claim 19 wherein said supply cartridge holding unit snaps said disposable supply cartridge onto top of said image-reproduction unit whereby said image-carrying medium compartment is adjacently located to said image-reproduction unit.

21. The apparatus for reproducing images according to claim 18 further comprising:

a content indicator located on the outer surface of said disposable supply cartridge for indicating information at least on a specific combination of said image-carrying medium and said image-recording medium; and a content reader operationally connected to said image-reproduction unit for reading the information and generating a content information signal for adjusting said image-reproduction unit.

22. The apparatus for reproducing images according to claim 21 wherein the information includes a first type of the image-recording medium, a second type of the image-carrying medium, a first amount of the image-recording medium and a second amount of the image-carrying medium.

23. A method of supplying consumable material to an image reproduction device, comprising:

packaging a first predetermined amount of a first consumable material in a disposable cartridge for use in reproduction of images;

packaging a second amount of a second consumable material in said disposable cartridge for use in the reproduction of the images, said second amount being corresponding to said first amount so that said first consumable material and said second consumable material are exhausted at a substantially same time over a course of ordinary image reproduction;

detachably placing said disposable cartridge in the reproduction device;

indicating information at least on a specific combination of said first consumable material and said second consumable material;

reading said information; and adjusting the reproduction device based upon said read information.

24. The method of supplying consumable material according to claim 23 wherein said first consumable material is image-carrying medium.

25. The method of supplying consumable material according to claim 23 wherein said second consumable is image-recording medium.

26. The method of supplying consumable material according to claim 23 wherein said information is optically read.

27. The method of supplying consumable material according to claim 23 wherein said information is mechanically read.

28. The method of supplying consumable material according to claim 23 wherein the reproduction device is adjusted based upon a type of said first consumable material.

29. The method of supplying consumable material according to claim 23 wherein the reproduction device is adjusted based upon a type of said second consumable material.

* * * * *